US006359262B1

(12) United States Patent
Robertson et al.

(10) Patent No.: US 6,359,262 B1
(45) Date of Patent: Mar. 19, 2002

(54) SUPPORT BRACKET FOR HEATER ELEMENT IN BAKE OVEN

(75) Inventors: John P. Robertson; Stacy V. Springer, both of Vernon, AL (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/697,585

(22) Filed: Oct. 26, 2000

(51) Int. Cl.[7] ..... A21B 1/22
(52) U.S. Cl. ..... 219/407; 219/402; 219/536
(58) Field of Search ..... 219/402, 407, 219/536, 537; 338/316–318

(56) References Cited

U.S. PATENT DOCUMENTS

| | | | | |
|---|---|---|---|---|
| 2,799,766 A | | 7/1957 | Tuttle | 219/37 |
| 3,005,082 A | | 10/1961 | Ammerman | 219/35 |
| 3,154,669 A | | 10/1964 | Binder | 219/404 |
| 3,770,939 A | | 11/1973 | Kokjohn | 219/532 |
| 4,272,638 A | | 6/1981 | Cimochowski | 13/25 |
| 4,392,052 A | | 7/1983 | Magnusson et al. | 219/532 |
| 6,008,478 A | * | 12/1999 | Crone et al. | 219/402 |
| 6,097,003 A | | 8/2000 | Markum et al. | 219/402 |
| 6,121,584 A | * | 9/2000 | Key et al. | 219/407 |

FOREIGN PATENT DOCUMENTS

| | | |
|---|---|---|
| CA | 626997 | 9/1961 |
| DE | 1 565 683 | 9/1966 |

* cited by examiner

*Primary Examiner*—Joseph Pelham
(74) *Attorney, Agent, or Firm*—Howrey Simon Arnold & White

(57) ABSTRACT

The present invention provides an apparatus to support an electrical heating element installed in an oven and extending generally horizontally therethrough from one side of the oven to the opposite side thereof for heating an oven cavity to bake or broil food set inside the oven cavity. The oven cavity has side walls, a top wall and a bottom wall. The apparatus and heating element are located below the bottom wall of the oven cavity. The apparatus includes at least one support bracket extending horizontally in the oven and has a plurality of openings formed therein each of which is generally presented in the upward vertical direction and sized to receive the heating element. The support bracket also has a plurality of standoffs generally presented in the upward vertical direction and having a height sufficient to prevent the bottom wall of the oven cavity from coming in contact with the heating element.

31 Claims, 4 Drawing Sheets

SUPPORT BRACKET FOR HEATER ELEMENT IN BAKE OVEN

FIELD OF THE INVENTION

The present invention relates generally to support bars or brackets for electric heating elements in bake ovens, and more particularly, to a support bar or bracket having standoffs to prevent the bottom of the bake oven cavity from touching the electric heating element.

BACKGROUND OF THE INVENTION

Conventional bake ovens have electric heating elements to produce heat to bake or broil food set in a cavity of the oven. It is typical to install an upper and lower heating element inside the oven cavity. The upper heating element is suspended immediately below the top wall of the oven cavity. The lower heating element is mounted above the bottom wall of the oven cavity. More recently, it has been known to install the lower heating element below the bottom wall of the oven cavity. Installing the heating element below the bottom wall of the oven cavity improves the appearance of the oven and makes the oven easier to clean. However, a problem occurs when installing the heating element below the bottom wall of the oven cavity. When the bottom wall reaches increased temperatures as a result of activating the heating element, the bottom wall of the oven cavity expands and warps. This may cause the bottom wall of the oven cavity to gravitate down and touch the heating element mounted below the bottom wall. Thus, for heating elements mounted below the bottom wall of an oven cavity, a need exists to prevent the bottom wall from touching the heating element when the wall expands and warps.

FIG. 1 shows a prior heater element support assembly 10 that attempts to solve the above problem. The support assembly 10 includes a heating element 12, four support brackets 14, four steel rods 16 and two legs 18. The assembly 10 is installed below the bottom wall of the cavity of a bake oven. The heating element 12 has electrical terminals 20 at each end. The terminals 20 attach to electrical receptacles (not shown) located at the back wall of the oven. The heating element 12 is contoured to have two serpentine sections S1 and S2 and a straight longitudinal section L1. The serpentine sections S1 and S2 of the heating element 12 are supported by the four support brackets 14. The longitudinal section L1 is supported by two legs 18. To prevent the bottom wall of the bake oven from touching the heating element 12, the assembly requires four steel rods 16 and two legs 18. The four steel rods 16 are mounted to the top of the support brackets 14 by crimping the rods 16 to slots in the support bracket. The two legs 18 are mounted on the straight longitudinal section L1 of the heating element 12 by crimping the legs to the heating element 12.

Although the above assembly will assist in preventing the bottom of the oven cavity from contacting the heating element, there is a further need to reduce the amount of material and parts used to perform this preventative function. The manufacture and sale of bake ovens is a high-volume industry. In such an industry, there is a continued need to reduce material costs and the number of parts for bake ovens. Moreover, there is a need to reduce assembly costs in fabricating a heating assembly. The assembly described in FIG. 1 takes excessive time to fabricate and assemble given the number of parts and the need to crimp the steel rods 16 and legs 18. Thus, it would be helpful to have a simple, readily installed support means which reliably supports the heating element while protecting the heating element from coming in contact with the bottom wall of the oven cavity.

The present invention is directed to overcoming, or at least reducing the effects of, one or more of the problems set forth above.

SUMMARY OF THE INVENTION

To that end, the present invention includes an apparatus supporting an electrical heating element installed in an oven and extending generally horizontally therethrough from one side of the oven to the opposite side thereof for heating an oven cavity to bake or broil food set inside the oven cavity. The oven cavity has side walls, a top wall and a bottom wall. The apparatus and heating element are located below the bottom wall of the oven cavity. The apparatus includes at least one support bracket extending horizontally in the oven and has a plurality of openings formed therein each of which is generally presented in the upward vertical direction and sized for the heating element to be installed in the openings. The support bracket also has a plurality of standoffs generally presented in the upward vertical direction and having a height sufficient to prevent the bottom wall of the oven cavity from coming in contact with the heating element.

The support bracket may also have a plurality of legs to allow the main body of the support bracket to generally stand apart from a bottom surface of the oven. The heating element may include electrical terminals that are connected to a circuit at the back wall of the oven. In one embodiment, a top portion of the plurality of standoffs are in a spaced apart relationship with the bottom wall of the oven cavity when the oven is turned off.

In another embodiment, the present invention includes a bracket supporting an electrical heating element installed in an oven and extending generally horizontally therethrough from one side of the oven to an opposite side thereof for heating the oven to cook food. The heating element has a sinuous shape and has a plurality of horizontally extending segments extending longitudinally in the oven. The bracket has a plurality of openings formed therein each of which is generally presented in the upward vertical direction and sized for a portion of the heating element to be received in the opening. The oven has an oven cavity wherein the oven cavity has side walls, a top wall and a bottom wall. The bracket and heating element are located below the bottom wall of the oven cavity. The bracket further has a plurality of standoffs generally presented in the upward vertical direction. The standoffs have a height sufficient to prevent the bottom wall of the oven cavity from coming in contact with the heating element when the bottom wall expands at an increased temperature.

In a further embodiment, the present invention is an oven to bake or broil food. The oven includes a cavity, an electrical heating element and at least one bracket. The cavity has side walls, a top wall and a bottom wall. The electrical heating element is located below the bottom wall of the cavity and extends generally horizontally in the oven from one side of the oven to an opposite side of the oven to heat the oven cavity. The bracket supports the heating element and also extends horizontally in the oven. The bracket has a plurality of openings and a plurality of standoffs. The plurality of openings are formed in the bracket and are generally presented in the upward vertical direction and sized to receive the heating element. The plurality of standoffs are also generally presented in the upward vertical direction but have a height sufficient to prevent the bottom wall of the cavity from coming in contact with the heating element.

The above summary of the present invention is not intended to represent each embodiment, or every aspect of the present invention. This is the purpose of the figures and detailed description that follows.

BRIEF DESCRIPTION OF THE DRAWINGS

Other objects and advantages of the invention will become apparent upon reading the following detailed description and upon reference to the drawings.

Figure 1:
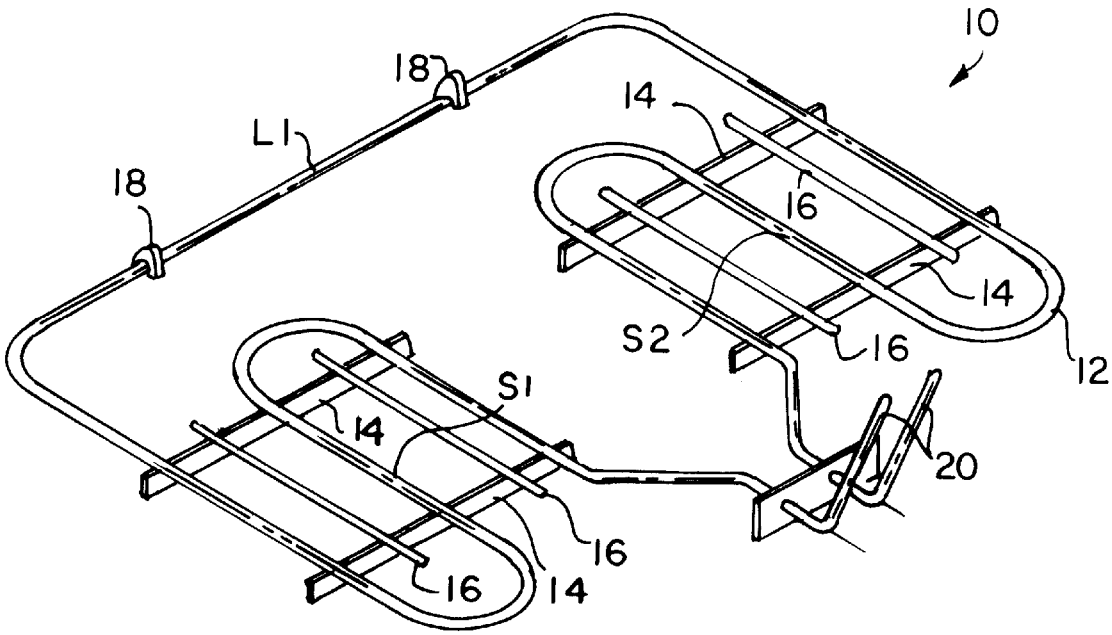
FIG. 1 (PRIOR ART)
FIG. 1 is a perspective view of a conventional, prior art heater element support assembly for a bake oven.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
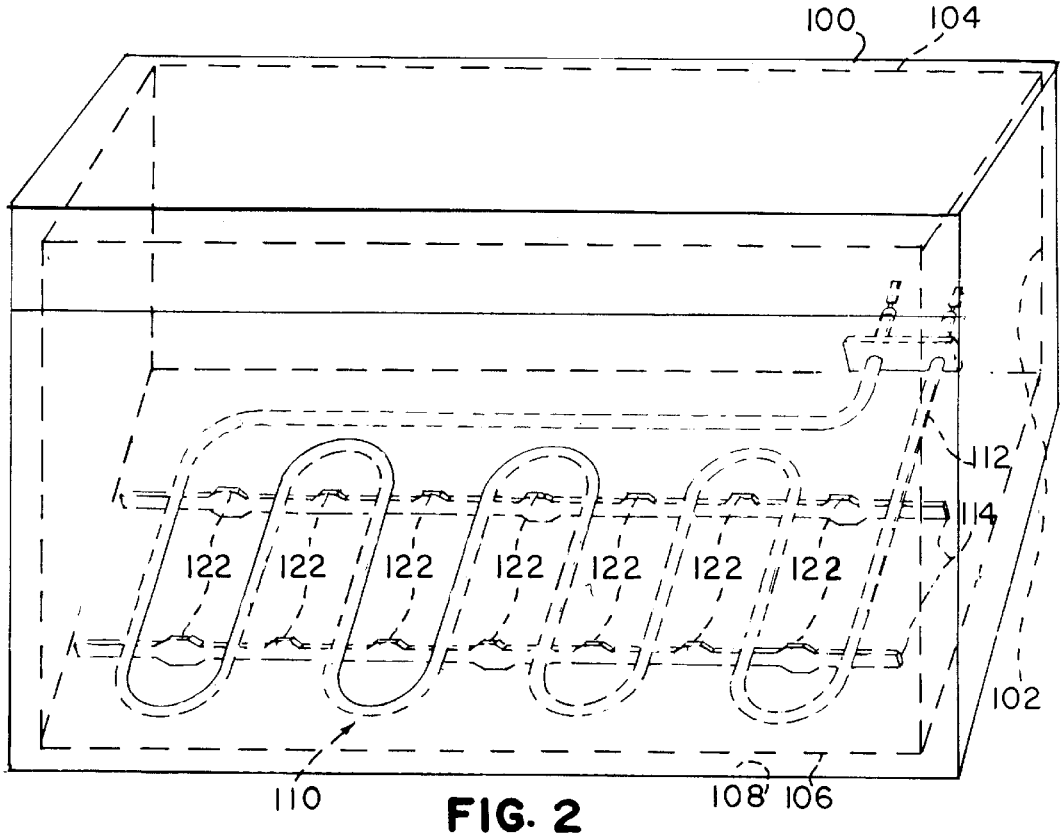
FIG. 2 is a perspective view of one embodiment of a support assembly of the present invention mounted inside a bake oven.

Illustrative embodiments will now be described with reference to the accompanying figures. Turning to the drawings, FIG. 2 depicts a bake oven 100 having an oven cavity 102. The oven cavity 102 has side walls, a top wall 104, and a bottom wall 106. The bake oven 100 has a heater element support assembly 110 mounted below the bottom wall 106 of the oven cavity 102. The heater element support assembly 110 includes a heating element 112 and at least one support bracket 114.

Figure 3:
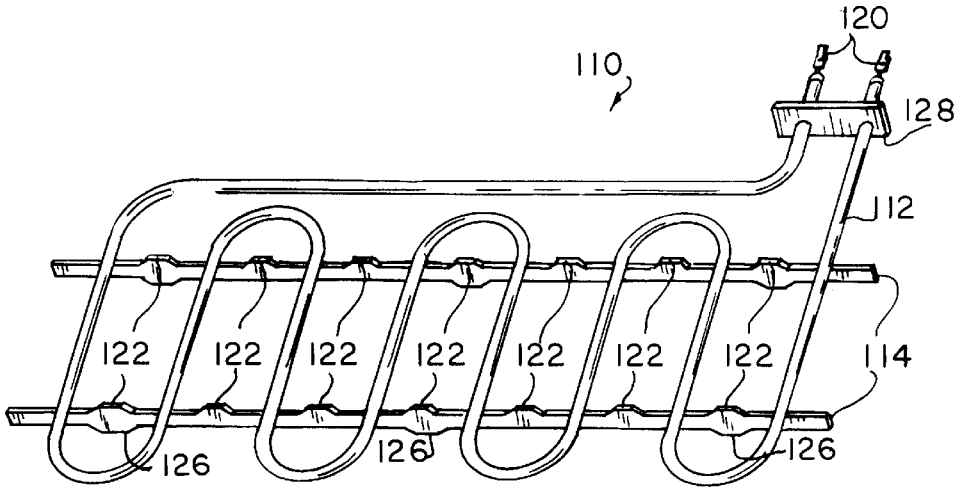
FIG. 3 is a perspective view of one embodiment of a support assembly of the present invention.

As illustrated in FIG. 3, the heating element 112 is contoured to have serpentine or sinuous sections for heating the oven cavity 102 to bake or broil food (not shown) set inside the oven cavity 102. The support brackets 114 extend generally horizontally from one side of the bake oven 110 to an opposite side of the bake oven 110. In one embodiment, the support brackets 114 are made of a metallic material such as steel, aluminum or cast iron.

Figure 4:
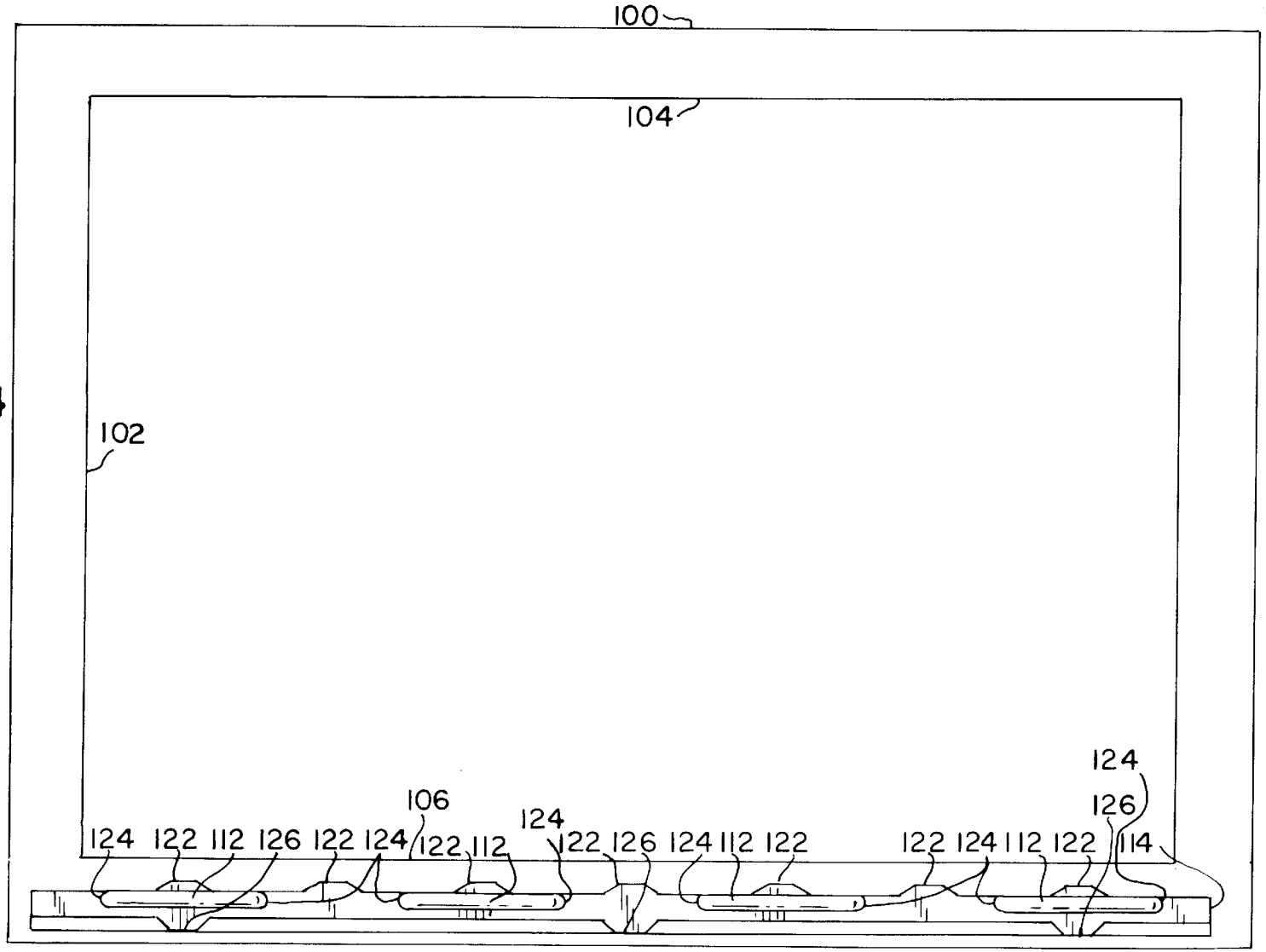
FIG. 4 is a side view of an oven containing the support assembly of FIG. 3.

FIG. 4 shows a side view of the heater element support assembly 110 inside the bake oven 100. As described above, the heater element support assembly 110 is located below the bottom wall 106 of the oven cavity 102.

The support brackets 114 are formed to include a plurality of openings 124. The openings 124 are generally presented in the upward vertical direction and sized for the heating element 112 to be installed in the openings 124. In one embodiment, the openings 124 are designed such that the heating element 112 simply slides onto the support bracket 114. In such a design, the openings 124 are in the shape of a U. In another embodiment, the openings 124 are designed such that the heating element 112 is staked or locked into place by a mechanical means.

The support brackets 114 are also formed to include a plurality of standoffs 122. The standoffs 122 are generally presented in the upward vertical direction and have a height sufficient to prevent the bottom wall 106 of the oven cavity 102 from coming in contact with the heating element 112. As shown in the figures, the standoffs 122 are located at spaced apart intervals along the top side of the support bracket 114. In one embodiment, a standoff 122 is located between each opening 124. The standoffs 122 may be a variety of shapes and sizes including square, rectangular, semi-circular, semi-elliptical or semi-hexagonal as shown in FIG. 4. In the preferred embodiment, the top surface of the standoffs 122 do not touch the bottom wall 106 of the oven cavity 102 when the oven 100 is turned off. Thus, it is preferred that the top surface of the standoffs 122 are in a spaced apart relationship with the bottom wall 106 when the heating element 112 is not activated. This allows the bottom wall 106 to expand and warp naturally as the heating element 112 is activated.

The support brackets 114 may further have legs 126 that allow the main body of the support brackets 114 to generally stand apart from the bottom surface 108 of the bake oven 100. When the heating element 112 is activated, the support brackets 114 will conduct heat and may expand and warp. Thus, legs 126 enable the support brackets 114 to expand naturally at increased temperatures relative to the bottom surface 108 of the bake oven 100.

Figure 5:
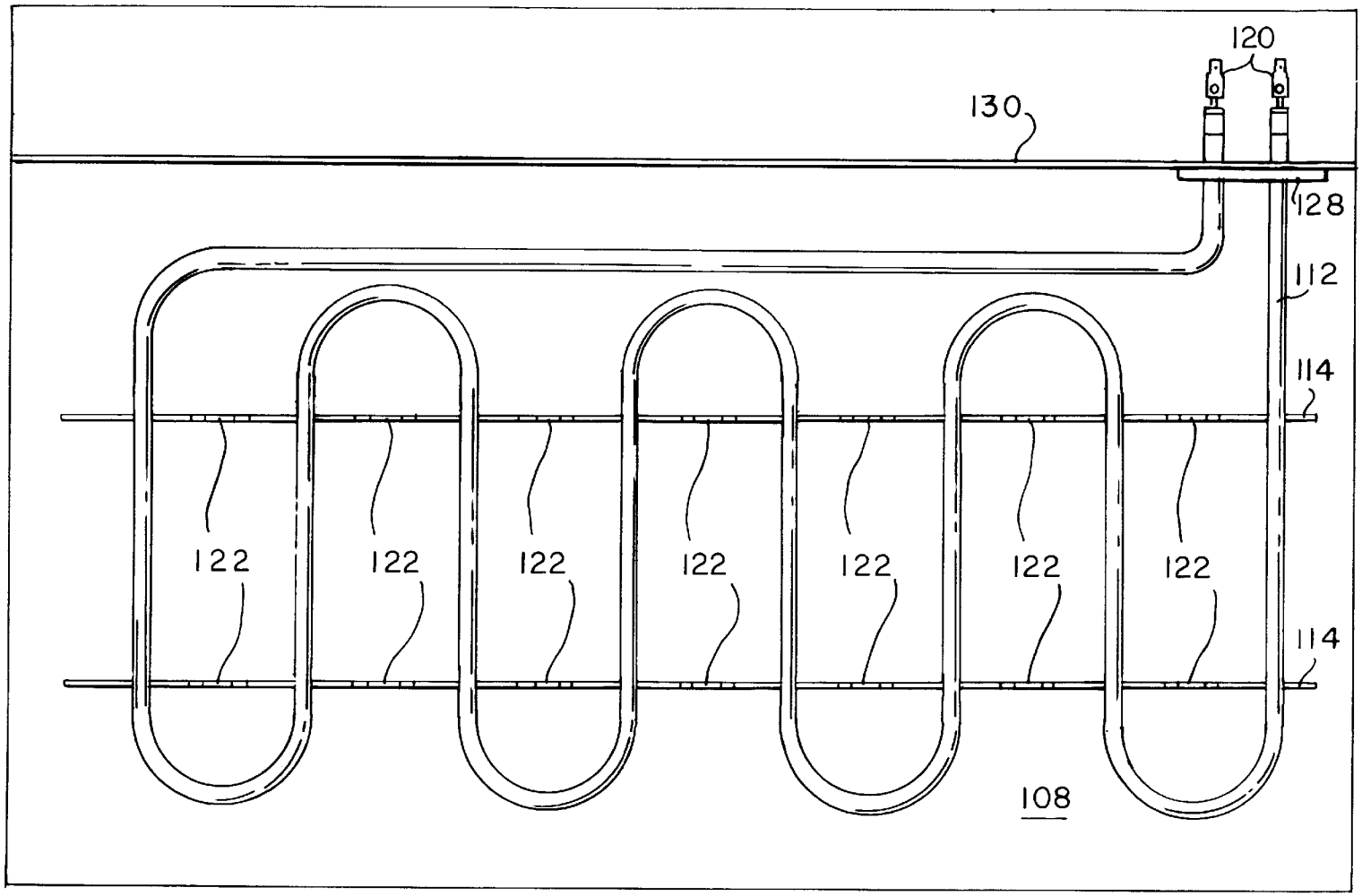
FIG. 5 is a plan view of the support assembly of FIG. 3.

FIG. 5 shows a plan view of the heater element support assembly 110 mounted below the bottom wall 106 of the oven cavity 102. The heating element 112 has terminals 120 that attach to electrical receptacles (not shown) located behind the back wall 130 of the oven cavity 102. The receptacles are electrically connected to a circuit at the back wall of the oven to control the heating element 112. A plate 128 is used to mount the heating element 112 to the back wall 130.

What has been described are brackets for bake ovens that support a heating element below the bottom wall of an oven cavity. The support brackets have a plurality of standoffs to prevent the bottom wall of the oven cavity from contacting the heating element when the bottom wall warps due to increased temperatures. The support bracket has a simple construction so the assembly requires fewer parts than is required for prior assemblies. This not only reduces costs, but also maintenance time.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. An apparatus supporting an electrical heating element installed in an oven and extending generally horizontally therethrough from one side of the oven to an opposite side thereof for heating an oven cavity to bake or broil food set inside the oven cavity, the oven cavity having side walls, a top wall and a bottom wall, the apparatus and heating element located below the bottom wall of the oven cavity, the apparatus comprising:

a support bracket extending horizontally in the oven and having a plurality of openings formed therein each of which is generally presented in the upward vertical direction and sized for the heating element to be installed in the openings;

wherein the support bracket has a plurality of standoffs formed integrally with the support bracket and generally presented in the upward vertical direction and having a height sufficient to prevent the bottom wall of the oven cavity from coming in contact with the heating element.

2. The apparatus of claim 1, wherein the support bracket further has a plurality of legs to allow the support bracket to generally stand apart from a bottom surface of the oven.

3. The apparatus of claim 1, wherein the apparatus includes a second support bracket, the second support bracket having a plurality of openings for the heating element to be installed in the openings, the second support bracket further having a plurality of standoffs formed integrally with the support bracket and generally presented in the upward vertical direction and having a height sufficient to prevent the bottom wall of the oven cavity from coming in contact with the heating element.

4. The apparatus of claim 1, wherein the heating element includes an electric terminal at each end thereof, the electrical terminals being electrically connected to a circuit at a back wall of the oven, the apparatus further having a mounting bracket to mount the heating element to the back wall of the oven.

5. The apparatus of claim 1, wherein a top portion of the plurality of standoffs are in a spaced apart relationship with the bottom wall of the oven cavity when the oven is turned off.

6. The apparatus of claim 1, wherein the plurality of openings in the support bracket are in the shape of a U.

7. The apparatus of claim 1, wherein the plurality of standoffs are semi-hexagonal.

8. The apparatus of claim 1, wherein the plurality of standoffs are rectangular.

9. A bracket supporting an electrical heating element installed in an oven and extending generally horizontally therethrough from one side of the oven to an opposite side thereof for heating the oven to cook food, the heating element having a sinuous shape and having a plurality of horizontally extending segments extending longitudinally of the oven, the bracket having a plurality of openings formed therein each of which is generally presented in the upward vertical direction and sized for a portion of a heating element segment to be received in the opening, the oven having an oven cavity, the oven cavity having side walls, a top wall and a bottom wall, the bracket and heating element located below the bottom wall of the oven cavity, the bracket having a plurality of standoffs formed integrally with the support bracket and generally presented in the upward vertical direction and having a height sufficient to prevent the bottom wall of the oven cavity from coming in contact with the heating element when the bottom wall expands at an increased temperature.

10. The bracket of claim 9, wherein the bracket further has a plurality of legs to allow the bracket to generally stand apart from a bottom surface of the oven.

11. The bracket of claim 9, wherein the heating element includes an electric terminal at each end thereof, the electrical terminals being electrically connected to a circuit at a back wall of the oven.

12. The bracket of claim 9, wherein a top portion of the plurality of standoffs are in a spaced apart relationship with the bottom wall of the oven cavity when the oven is turned off.

13. The bracket of claim 9, wherein the plurality of openings in the bracket are in the shape of a U.

14. The bracket of claim 9, wherein the plurality of standoffs are semi-hexagonal.

15. An oven to bake or broil food, the oven comprising:

a cavity for placing the food, the cavity having side walls, a top wall and a bottom wall;

an electrical heating element located below the bottom wall of the cavity, the heating element extending generally horizontally in the oven from one side of the oven to an opposite side thereof for heating the oven cavity; and a bracket for supporting the heating element, the bracket extending horizontally in the oven and having a plurality of openings formed therein each of which is generally presented in the upward vertical direction and sized for the heating element to be installed in the openings;

wherein the bracket has a plurality of standoffs formed integrally with the support bracket and generally presented in the upward vertical direction and having a height sufficient to prevent the bottom wall of the cavity from coming in contact with the heating element.

16. The oven of claim 15, wherein the bracket further has a plurality of legs to allow the bracket to generally stand apart from a bottom surface of the oven.

17. The oven of claim 15, wherein the apparatus includes a second bracket, the second bracket having a plurality of openings for the heating element to be installed in the openings, the second bracket further having a plurality of standoffs formed integrally with the support bracket and generally presented in the upward vertical direction and having a height sufficient to prevent the bottom wall of the oven cavity from coming in contact with the heating element.

18. The oven of claim 15, wherein the heating element includes an electric terminal at each end thereof, the electrical terminals being electrically connected to a circuit at a back wall of the oven, the oven further having a mounting bracket to mount the heating element to the back wall of the oven.

19. The oven of claim 15, wherein a top portion of the plurality of standoffs are in a spaced apart relationship with the bottom wall of the cavity when the oven is turned off.

20. The oven of claim 15, wherein the plurality of standoffs are semi-hexagonal.

21. An apparatus supporting an electrical heating element installed in an oven and extending generally horizontally therethrough from one side of the oven to an opposite side thereof for heating an oven cavity to bake or broil food set inside the oven cavity, the oven cavity having side walls, a top wall and a bottom wall, the apparatus and heating element located below the bottom wall of the oven cavity, the apparatus comprising:

a support bracket extending horizontally in the oven and having a plurality of openings formed therein each of which is generally presented in the upward vertical direction and sized for the heating element to be installed in the openings;

wherein the support bracket has a plurality of standoffs generally presented in the upward vertical direction and having a height sufficient to prevent the bottom wall of the oven cavity from coming in contact with the heating element;

wherein the support bracket further has a plurality of legs to allow the support bracket to generally stand apart from a bottom surface of the oven.

22. The apparatus of claim 21, wherein the apparatus includes a second support bracket, the second support bracket having a plurality of openings for the heating element to be installed in the openings, the second support bracket further having a plurality of standoffs generally presented in the upward vertical direction and having a height sufficient to prevent the bottom wall of the oven cavity from coming in contact with the heating element.

23. The apparatus of claim 21, wherein a top portion of the plurality of standoffs are in a spaced apart relationship with the bottom wall of the oven cavity when the oven is turned off.

24. The apparatus of claim 21, wherein the plurality of standoffs are semi-hexagonal.

25. A bracket supporting an electrical heating element installed in an oven and extending generally horizontally therethrough from one side of the oven to an opposite side thereof for heating the oven to cook food, the heating element having a sinuous shape and having a plurality of horizontally extending segments extending longitudinally of the oven, the bracket having a plurality of openings formed therein each of which is generally presented in the upward vertical direction and sized for a portion of a heating element segment to be received in the opening, the oven having an oven cavity, the oven cavity having side walls, a top wall and a bottom wall, the bracket and heating element located below the bottom wall of the oven cavity, the bracket having a plurality of standoffs generally presented in the upward vertical direction and having a height sufficient to prevent the bottom wall of the oven cavity from coming in contact with the heating element when the bottom wall expands at an increased temperature, the bracket further having a plurality of legs to allow the bracket to generally stand apart from a bottom surface of the oven.

26. The bracket of claim 25, wherein a top portion of the plurality of standoffs are in a spaced apart relationship with the bottom wall of the oven cavity when the oven is turned off.

27. The bracket of claim 25, wherein the plurality of standoffs are semi-hexagonal.

28. An oven to bake or broil food, the oven comprising:

a cavity for placing the food, the cavity having side walls, a top wall and a bottom wall;

an electrical heating element located below the bottom wall of the cavity, the heating element extending generally horizontally in the oven from one side of the oven to an opposite side thereof for heating the oven cavity; and a bracket for supporting the heating element, the bracket extending horizontally in the oven and having a plurality of openings formed therein each of which is generally presented in the upward vertical direction and sized for the heating element to be installed in the openings;

wherein the bracket has a plurality of standoffs generally presented in the upward vertical direction and having a height sufficient to prevent the bottom wall of the cavity from coming in contact with the heating element, wherein the bracket further has a plurality of legs to allow the bracket to generally stand apart from a bottom surface of the oven.

29. The oven of claim 28, wherein the oven further includes a second bracket, the second bracket having a plurality of openings for the heating element to be installed in the openings, the second bracket further having a plurality of standoffs generally presented in the upward vertical direction and having a height sufficient to prevent the bottom wall of the oven cavity from coming in contact with the heating element.

30. The oven of claim 28, wherein a top portion of the plurality of standoffs are in a spaced apart relationship with the bottom wall of the oven cavity when the oven is turned off.

31. The oven of claim 28, wherein the plurality of standoffs are semi-hexagonal.

* * * * *